US010107578B1

(12) United States Patent
Mirabel

(10) Patent No.: US 10,107,578 B1
(45) Date of Patent: Oct. 23, 2018

(54) CASING CATCHER FOR AR-STYLE RIFLE

(71) Applicant: Michael R. Mirabel, Folsom, CA (US)

(72) Inventor: Michael R. Mirabel, Folsom, CA (US)

( * ) Notice: Subject to any disclaimer, the term of this patent is extended or adjusted under 35 U.S.C. 154(b) by 0 days.

(21) Appl. No.: 15/697,682

(22) Filed: Sep. 7, 2017

(51) Int. Cl.
*F41A 9/60* (2006.01)

(52) U.S. Cl.
CPC ..... *F41A 9/60* (2013.01)

(58) Field of Classification Search
CPC ..... F41A 9/60; F41A 9/81
USPC ..... 42/98
See application file for complete search history.

(56) References Cited

U.S. PATENT DOCUMENTS 577,452 A * 2/1897 Richardson ..... A47L 13/52 15/257.2
663,262 A * 12/1900 Dieterich ..... F41A 9/60 224/0.5
1,201,189 A * 10/1916 Johnson ..... F41A 9/60 224/0.5
2,354,277 A * 7/1944 Richardson ..... F41A 9/60 42/98
3,153,981 A * 10/1964 Brass ..... F41A 9/60 42/98
3,658,241 A * 4/1972 Pistocchi ..... F41A 9/60 232/1 R
3,739,685 A * 6/1973 Lundgren ..... F41A 9/60 42/98
4,166,333 A * 9/1979 Kratzer ..... F41A 9/60 42/98
4,903,426 A * 2/1990 Bammate ..... F41A 9/60 42/98
5,398,439 A * 3/1995 Harless ..... F41A 9/60 42/98
5,651,208 A * 7/1997 Benson ..... F41A 9/60 42/106
7,043,863 B2 * 5/2006 Saur ..... F41A 9/60 206/3
7,536,821 B1 * 5/2009 Saur ..... F41A 9/60 181/252
2005/0188599 A1 * 9/2005 Saur ..... F41A 9/60 42/98
2006/0248776 A1 * 11/2006 Saur ..... F41A 9/60 42/98

* cited by examiner

*Primary Examiner* — Samir Abdosh
(74) *Attorney, Agent, or Firm* — Craig A. Simmermon

(57) ABSTRACT

Casing catcher for AR-style rifle is an ammunition cartridge casing catcher, shell casing catcher, or brass catcher that is reversibly attachable to any AR-style rifle. Casing catcher for AR-style rifle uses a reversibly attachable means to magnetically reversibly attach to the inside surface of the ejection port cover on any AR-style rifle with a two key picatinny rail attachment system to reversibly align itself properly and attach itself to the AR-style rifle. Casing catcher for AR-style rifle has a cage, a magnetic weir plate, a lock pin receiver, a lock pin, a first key, and a second key. Magnetic weir plate has at least one magnet attached thereto. The first key to has a special shape or profile that includes a special right facing foot protuberance that is the inverse shape of the left side of the picatinny rail on any AR-style rifle. The second key has a special shape or profile that includes a special left facing foot protuberance that is the inverse shape of the right side of the picatinny rail on any AR-style rifle.

1 Claim, 7 Drawing Sheets

CASING CATCHER FOR AR-STYLE RIFLE

BACKGROUND OF THE INVENTION

1. Field of the Invention

This invention pertains to an ammunition cartridge casing catcher, shell casing catcher, or brass catcher that is reversibly attachable to any AR-style rifle. When the invention is attached to an AR-style rifle, the invention functions to catch, save, and accumulate all spent ammunition casings that are ejected from the rifle where the rifle ejects one such spent ammunition casing each time the rifle is fired.

2. Description of Related Art

The AR-Style rifle was first developed in the 1950's by Eugene Stoner and the ArmaLite Company, which was a division of Fairchild Engine and Aircraft Corporation at that time. The AR stands for ArmaLite. ArmaLite developed many rifles with the designation of AR including: AR-5, AR-10, and AR-15. The AR-15 rifle design is the most widely used of the different AR-Style designs. An ejection port cover is a feature on all AR-Style rifles. A picatinny rail is a feature on most AR-Style rifles. A picatinny rail is also known as a pic rail, a MIL-STD-1913 rail, or a standardization agreement 2324 rail. This invention reversibly attaches to the ejection port cover and picatinny rail of any AR-Style rifle.

There are many ammunition cartridge casing catchers, shell casing catchers, or brass catchers in the prior art that are reversibly attachable to an AR-Style rifle. However, none include a reversibly attachable means to magnetically reversibly attach to the inside surface of the ejection port cover on any AR-style rifle combined with a two key picatinny rail attachment system to reversibly align itself properly and attach itself to the AR-style rifle. The magnetic reversible attachment means with two key picatinny rail attachment system is further described below.

BRIEF SUMMARY OF THE INVENTION

It is an aspect of casing catcher for AR-style rifle to catch, save, and accumulate all spent ammunition casings that are ejected from the rifle where the rifle ejects one such spent ammunition casing each time the rifle is fired.

It is an aspect of casing catcher for AR-style rifle to include a cage to catch, save, and accumulate therein all spent ammunition casings that are ejected from the rifle.

It is an aspect of casing catcher for AR-style rifle to utilize a reversibly attachment means to reversibly itself to any AR-style rifle.

It is an aspect of reversibly attachment means to magnetically attach to the inside surface of an open ejection port cover on any AR-style rifle.

It is an aspect of reversibly attachment means to utilize one or more magnets to reversibly attach itself to the inside surface of an open ejection port cover on any AR-style rifle.

It is an aspect of reversibly attachment means to utilize a locating notch to align itself over the protrusion from the detent on the inside surface of an open ejection port cover on any AR-style rifle.

It is an aspect of casing catcher for AR-style rifle to utilize a two key picatinny rail attachment system to reversibly align itself and reversibly attach itself to the picatinny rail on any AR-style rifle.

It is an aspect of two key picatinny rail attachment system to locate and reversibly attach both keys within one slot or groove in the picatinny rail on any AR-style rifle.

It is an aspect of each key to have a special shape or profile that forms a slip fit or press fit within one slot or groove in the picatinny rail on any AR-style rifle.

It is an aspect of one key to have a special shape or profile that includes a special right facing foot protuberance that is the inverse shape of the left side of the picatinny rail on any AR-style rifle.

It is an aspect of the other key to have a special shape or profile that includes a special left facing foot protuberance that is the inverse shape of the right side of the picatinny rail on any AR-style rifle.

It is an aspect of the two key picatinny rail alignment system to utilize a lock pin to reversibly attach and lock both keys to casing catcher for AR-style rifle.

DEFINITION LIST

Figure 1:
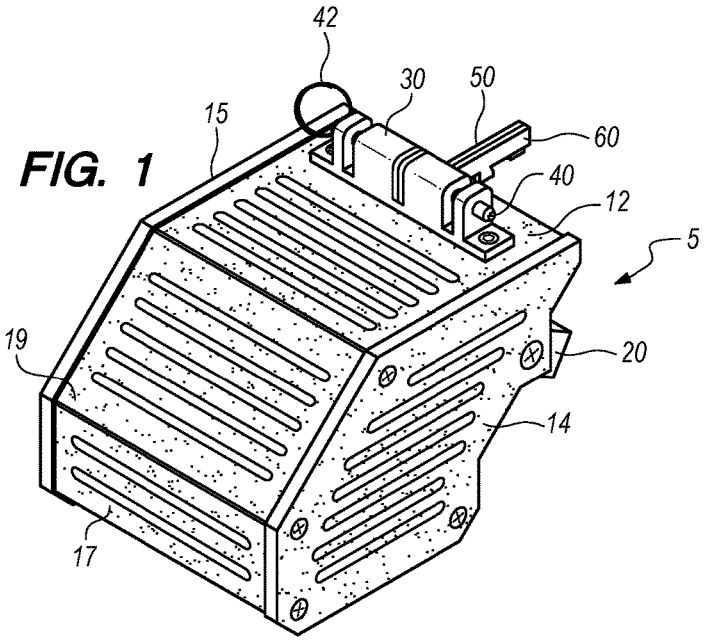
FIG. 1 is a right front perspective view of casing catcher for AR-style rifle.
Figure 2:
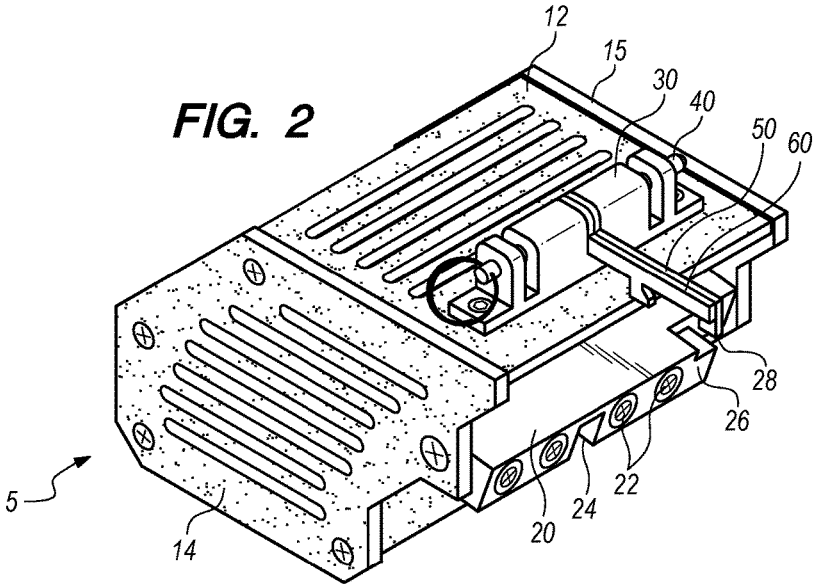
FIG. 2 is a front left perspective view of casing catcher for AR-style rifle.
Figure 3:
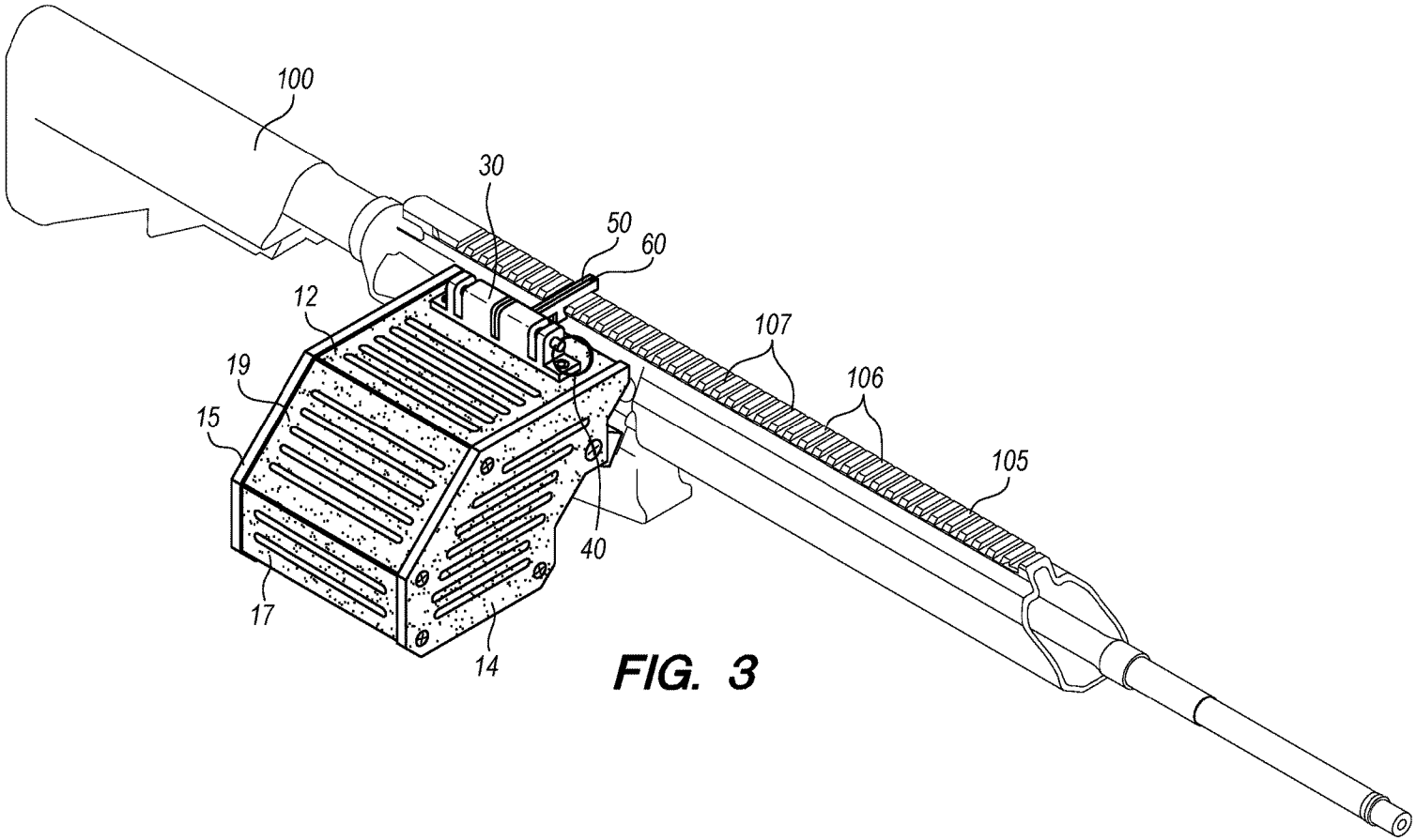
FIG. 3 is a perspective view of casing catcher for AR-style rifle properly attached to an AR-style rifle.
Figure 4:
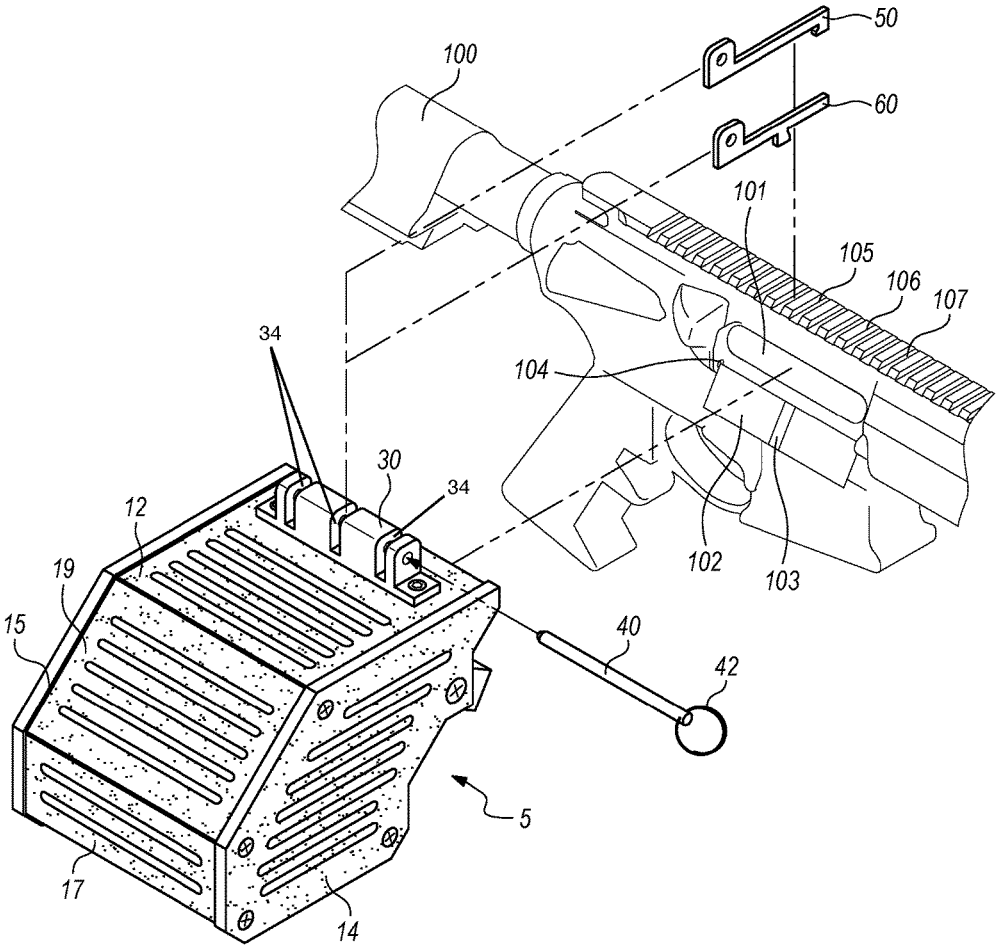
FIG. 4 is an exploded perspective view of casing catcher for AR-style rifle and AR-style rifle.
Figure 5:
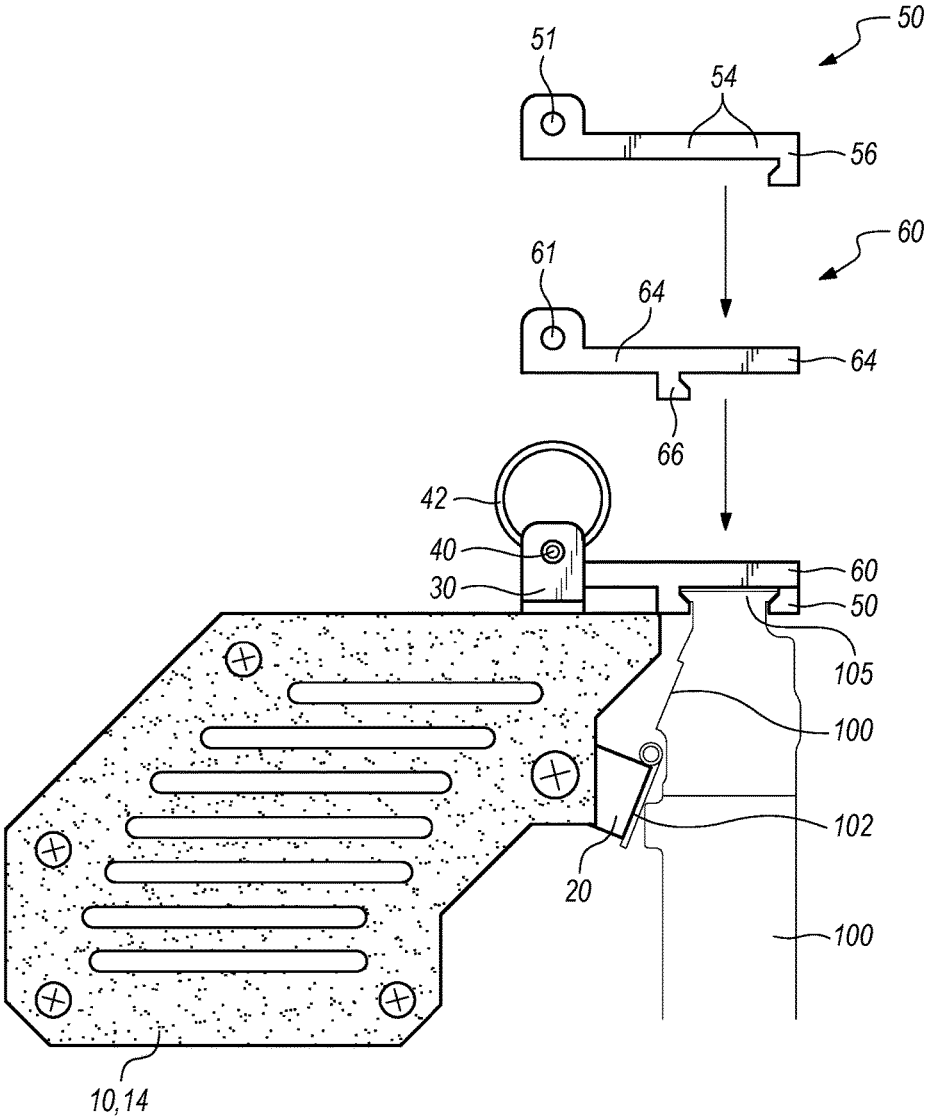
FIG. 5 is a partially exploded front elevation view of casing catcher for AR-style rifle and AR-style rifle.
Figure 6:
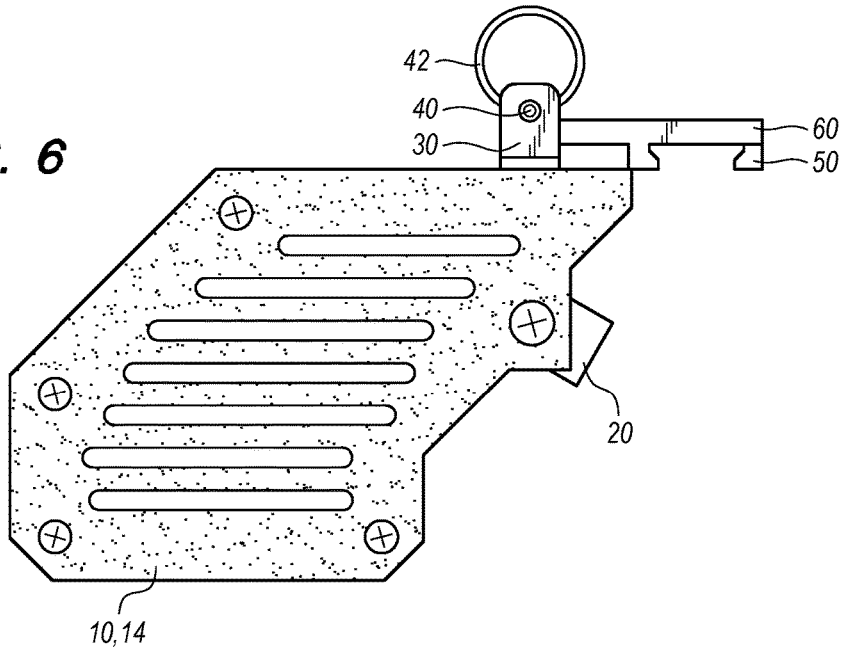
FIG. 6 is a front elevation view of casing catcher for AR-style rifle.
Figure 7:
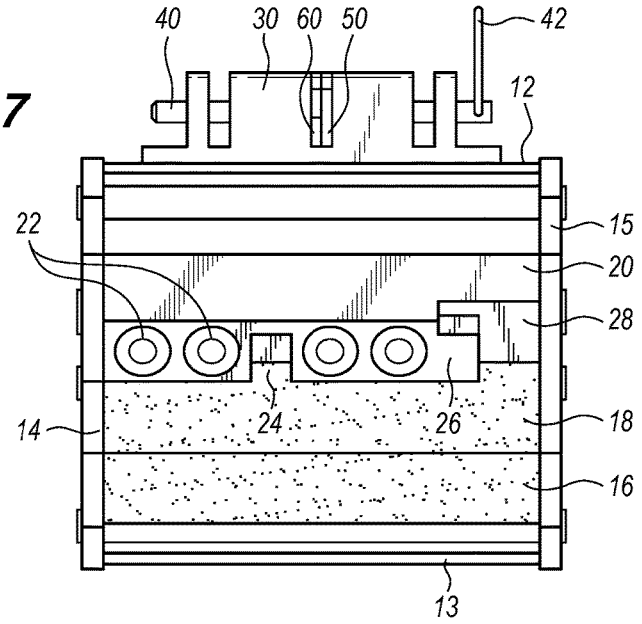
FIG. 7 is a left side elevation view of casing catcher for AR-style rifle.
Figure 8:
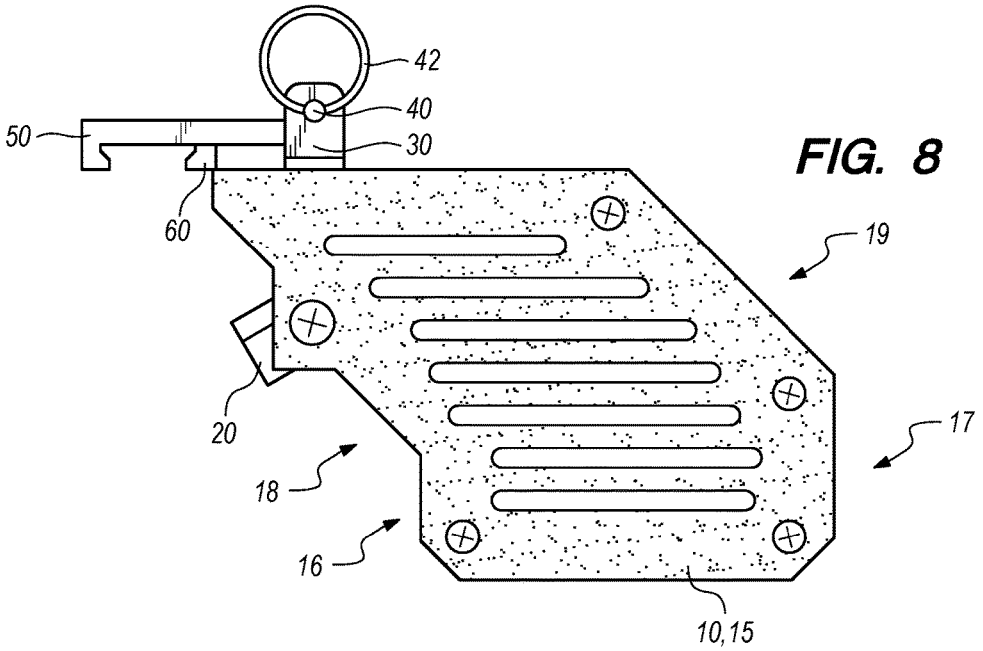
FIG. 8 is a rear elevation view of casing catcher for AR-style rifle.
Figure 9:
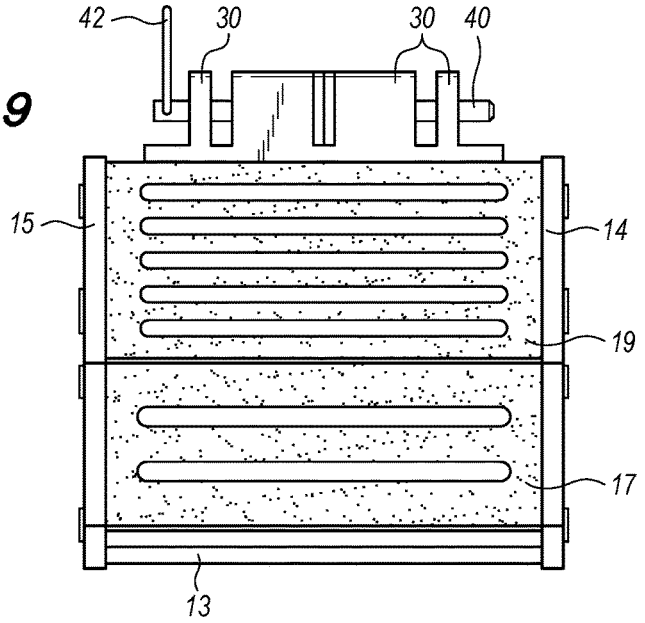
FIG. 9 is a right side elevation view of casing catcher for AR-style rifle.
Figure 10:
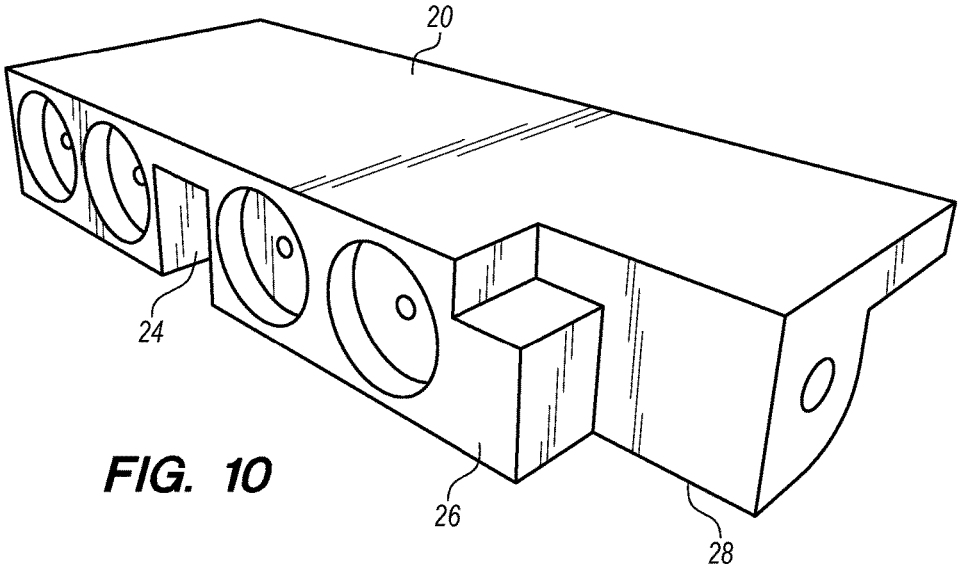
FIG. 10 is a perspective view of magnetic weir plate.

| Term | Definition |
|---|---|
| 5 | Casing Catcher for AR-Style Rifle |
| 10 | Cage |
| 12 | Cage Upper Side |
| 13 | Cage Lower Side |
| 14 | Cage Front Side |
| 15 | Cage Rear Side |
| 16 | Cage Left Side |
| 17 | Cage Right Side |
| 18 | Left Diagonal Side |
| 19 | Right Diagonal Side |
| 20 | Magnetic Weir Plate |
| 22 | Magnet |
| 24 | Alignment Notch |
| 26 | Ejection Port Cover Hinge Tab |
| 28 | Ambidextrous Bolt Catch Clearance Notch |
| 30 | Lock Pin Receiver |
| 32 | Lock Pin Bore |
| 34 | Key Slot |
| 40 | Lock Pin |
| 42 | Lock Pin Ring |
| 50 | First Key |
| 52 | First Key Lock Pin Hole |
| 54 | First Key Shaft |
| 56 | Right Facing Foot Protuberance |
| 60 | Second Key |
| 62 | Second Key Lock Pin Hole |
| 64 | Second Key Shaft |

-continued

DEFINITION LIST

| Term | Definition |
|---|---|
| 66 | Left Facing Foot Protuberance |
| 100 | AR-Style Rifle |
| 101 | Ejection Port |
| 102 | Ejection Port Cover |
| 103 | Ejection Port Cover Detent |
| 104 | Rear Protrusion on Ejection Port Cover Hinge |
| 105 | Picatinny Rail |
| 106 | Ridge in Picatinny Rail |
| 107 | Groove in Picatinny Rail |

DETAILED DESCRIPTION OF THE INVENTION

Casing catcher for AR-style rifle 5 comprises: a cage 10; a magnetic weir plate 20; a lock pin receiver 30; a lock pin 40; a first key 50; and a second key 60.

Cage 10 comprises: an upper side 12, a lower side 13, a front side 14, a rear side 15, a left side 16, and a right side 17. Cage 10 is an enclosed container or cage that functions to catch, save, and accumulate all spent ammunition casings that are ejected from the AR-style rifle 100. Upper side 12 is a rigid horizontal rigid planar member with an upper surface, a lower surface, a front edge, a right edge, a rear edge, and a left edge. Lower side 13 is a rigid horizontal planar member with an upper surface, a lower surface, a front edge, a right edge, a rear edge, and a left edge. Front side 14 is a rigid vertical planar member with a front surface, a rear surface, an upper edge, a right edge, a lower edge, and a left edge. Rear side 15 is a rigid vertical planar member with a front surface, a rear surface, an upper edge, a right edge, a lower edge, and a left edge. Left side 16 is a rigid vertical planar member with a left surface, a right surface, a front edge, an upper edge, a rear edge, and a lower edge. Right side 17 is a rigid vertical planar member with a left surface, a right surface, a front edge, an upper edge, a rear edge, and a lower edge. Rigid planar members may be continuous and without holes, apertures, or slots. Alternately, rigid planar members may have holes, apertures, or slots. Best mode planar members include holes, apertures, or slots, which function to allow for faster dissipation of heat from the spent ammunition casings, which are very hot after ejection from the AR-style rifle 100. Rigid planar members are depicted with heat dissipation slots. Holes, apertures, or slots may not have an overall dimension or width that is greater than that of the spent ammunition casings in order to prevent the spent ammunition casing from falling through the holes, apertures, or slots.

The front edge of upper side 12 is rigidly attached to the upper edge of front side 14. The right edge of upper side 12 is rigidly attached to or is immediately adjacent to the upper edge of right side 17. The rear edge of upper side 12 is rigidly attached to the upper edge of rear side 15. The front edge of lower side 13 is rigidly attached to the lower edge of front side 14. The right edge of lower side 13 is rigidly attached to or is immediately adjacent to the lower edge of right side 15. The rear edge of lower side 13 is rigidly attached to the lower edge of rear side 15. The left edge of lower side 13 is rigidly attached to or is immediately adjacent to lower edge of left side 14. The front edge of left side 16 is rigidly attached to left edge of front side 14. The rear edge of left side 16 is rigidly attached to the left edge of rear side 15. The front edge of right side 17 is rigidly attached to right edge of front side 14. The rear edge of right side 17 is rigidly attached to the right edge of rear side 15.

Rigid attachment between edges of sides 12,13,14,15,16,17 functions to retain spent ammunition casings between sides 12,13,14,15,16,17 and to prevent spent ammunition casings from falling out of cage 10. Rigid attachment may be accomplished by any known means such as by fasteners, screws, bolts, mortise and tenon joint, dovetail joint, tongue and groove joint, any known type of joint, sonic welding, welding, glue, adhesive, or epoxy. Likewise, the immediate adjacent placement of edges of sides is used to retain spent ammunition casings between sides 12,13,14,15,16,17 and to prevent spent ammunition casings from falling out of cage 10. The seam or gap between edges positioned immediately adjacent to each other must be less than the overall width of the spent ammunition casings or less than about one third of an inch.

The upper edge of left side 16 is not attached to or adjacent to the left edge of upper side 12 in order to provide a gap or hole between upper edge of left side 16 and the left edge of upper side 12. This gap provides clearance space for spent ammunition casings to enter or fall into cage 10 after being ejected from the AR-style rifle 100. Magnetic weir plate 20 is installed within this gap as described below.

Alternately, there may be a left diagonal side 18 in order to provide for a larger cage volume. Left diagonal side 18 is a rigid diagonal planar member with a left surface, a right surface, a front edge, an upper edge, a rear edge, and a lower edge. In this mode, the lower edge of left diagonal side 18 is rigidly attached to or is immediately adjacent to the upper edge of left side 16. The front edge of left diagonal side 18 is rigidly attached to left edge of front side 14. The rear edge of left diagonal side 18 is rigidly attached to the left edge of rear side 15.

Alternately, there may be a right diagonal side 19 in order to provide for a larger cage volume. Right diagonal side 19 is a rigid diagonal planar member with a left surface, a right surface, a front edge, an upper edge, a rear edge, and a lower edge. In this mode, the lower edge of right diagonal side 19 is rigidly attached to or is immediately adjacent to the upper edge of right side 17. The front edge of right diagonal side 19 is rigidly attached to right edge of front side 14. The rear edge of right diagonal side 19 is rigidly attached to the right edge of rear side 15. Left diagonal side 18 and right diagonal side 19 are roughly parallel to each other. Best mode includes left diagonal side 18 and right diagonal side 19 as depicted.

Rigid attachment between edges of sides is used to retain spent ammunition casings between sides 12,13,14,15,16,17,18,19 and to prevent spent ammunition casings from falling out of cage 10. Rigid attachment may be accomplished by any known means such as by fasteners, screws, bolts, mortise and tenon joint, dovetail joint, tongue and groove joint, any known type of joint, sonic welding, welding, glue, adhesive, or epoxy. Likewise, the immediate adjacent placement of edges of sides is used to retain spent ammunition casings between sides 12,13,14,15,16,17,18,19 and to prevent spent ammunition casings from falling out of cage 10. The seam between edges positioned immediately adjacent to each other must be less than the overall width of the spent ammunition casings or less than about one third of an inch.

The upper edge of left diagonal side 18 is not attached to or adjacent to the left edge of upper side 12 in order to provide a gap between upper edge of left diagonal side 18 and the left edge of upper side 12. This gap provides clearance space for spent ammunition casings to enter or fall into the cage 10 after being ejected from the AR-style rifle 100. Magnetic weir plate 20 is installed within this gap as described below.

Magnetic weir plate 20 is a rigid diagonal planar member with an upper surface, a lower surface, a front edge, a right edge, a rear edge, and a left edge. Magnetic weir plate 20 is position diagonally with its right edge located above its left edge where the left edge of magnetic weir plate 20 is directed downwards and the right edge of magnetic weir plate 20 is directed upwards as depicted. The right edge of magnetic weir plate 20 is located within the interior of cage 10. The left edge of magnetic weir plate 20 is located just outside of the interior of cage 10. The front edge of magnetic weir plate 20 is rigidly attached to the rear surface of front side 14. The rear edge of magnetic weir plate 20 is rigidly attached to the front surface of rear side 15. Rigid attachment is such as to prevent spent ammunition casing from falling through between the attached members. Magnetic weir plate 20 is positioned so that a spent ammunition casing must travel uphill so to speak along the upper surface of magnetic weir plate 20 in order to fall into cage 10. This does not pose a hindrance to the spent ammunition casing travelling into the cage 10 as every spent ammunition casing is ejected with some velocity perpendicularly outwards from the AR-style rifle 100 after being fired.

The main purpose of the diagonal positioning of the magnetic weir plate 20 is to force all bouncing spent casings back into the cage 10 when they bounce upwards. Sometimes, spent casings already accumulated in the bottom of cage 10 may bounce upwards as a result of a new spent casing being ejected forcefully down onto them. Other times, the new spent casing being ejected bounce upwards as a result being ejected forcefully down onto spent casings already accumulated in the bottom of cage 10. Either way, the diagonal positioning of the magnetic weir plate 20 prevents the casings from bouncing back out of cage 10.

The left edge of magnetic weir plate 20 further comprises at least one magnet 22. At least one magnet 22 is rigidly attached to the left edge of magnetic weir plate 20. Magnet 22 is a magnet. Any known type of magnet may be used. At least one magnet 22 functions to reversibly attach or magnetically attach casing catcher for AR-style rifle 5 onto the inside surface of an open ejection port cover 102 on any AR-Style rifle 100.

Every AR-style rifle 100 has an ejection port 101 and an ejection port cover 102 located on the right side of the rifle 100. Ejection port 101 and ejection port cover 102 are each standard components of any AR-style rifle 100. Ejection port 101 is a void, gap, or hole the upper receiver of AR-style rifle 100 on the right side. Ejection port 101 functions to allow spent ammunition casings to exit the chamber and pass through the ejection port 101 in order to exit the rifle 100. Ejection port cover 102 covers ejection port 101. Ejection port cover 102 is a rigid planar member with an inside surface, an outside surface, an upper end, a lower end, a left end, and a right end. Ejection port cover 102 functions to cover ejection port 101 and protect the firing chamber and bolt of the rifle 100 from the outside elements such as dirt, dust, water, rain, snow, etc. Ejection port cover 102 hinges, rotates, or pivots downward to open and hinges, rotates, or pivots back upward to close. A hinge for this pivotal attachment is located at the lower end of ejection port cover 102. Ejection port cover 102 reversibly pivots around its lower end as depicted. Ejection port cover 102 may be closed by simply pressing it upwards until an ejection port cover detent 103 snaps onto the top of ejection port 101 to automatically snap and lock the ejection port cover 102 closed. Ejection port cover 102 automatically opens when a round is fired, when the bolt is pulled back, or when the bolt is released forward. Ejection port cover 102 must be open in order to properly attach casing catcher for AR-style rifle 5 onto AR-style rifle 100. The inside surface of ejection port cover 102 faces the firing chamber and bolt of the rifle 100 or to the left when ejection port cover 102 is closed. The outside surface of ejection port cover 102 faces to the right when ejection port cover 102 is closed.

Magnet 22 has an upper surface and a lower surface. The upper surface of magnet 22 is rigidly attached to the left edge of magnetic weir plate 20. Any known type of rigid attachment may be used including any known type of fastener, rivet, welding, glue, adhesive, or epoxy. In best mode, a fastener, namely a screw is used to attach magnet 22 to the left edge of magnetic weir plate 20, as depicted. The lower surface of magnet 22 is reversibly attachable or magnetically attachable to the inside surface of open ejection port cover 102. The lower surface of magnet 22 is a rigid planar surface that is parallel with the left edge of magnetic weir plate 20, which is also a rigid planar surface. The left edge of magnetic weir plate 20 is sized, shaped, and located so that it is parallel with the inside surface of open ejection port cover 102 as depicted. This parallel alignment between the inside surface of open ejection port cover 102 and the left edge of magnetic weir plate 20 is critical to proper reversibly attachment or magnetic attachment casing catcher for AR-style rifle 5 to AR-style rifle 100. Casing catcher for AR-style rifle 5 may alternately comprise more than one magnet 22, however, it is entirely possible to achieve the required reversible magnetic attachment with only one magnet 22. In best mode, there are four magnets 22 rigidly attached to the left edge of magnetic weir plate 20, as depicted.

The left edge of magnetic weir plate 20 further comprises an alignment notch 24. Alignment notch 24 is a slot, notch, cavity, or keyhole in the middle of left edge of magnetic weir plate 20. Alignment notch 24 is oblong shaped with a vertical longitudinal axis, an upper end, and a lower end. The lower end of alignment notch 24 breaks through the lower surface of magnetic weir plate 20 as depicted. The upper end of alignment notch 24 does not break through the upper surface of magnetic weir plate 20 as depicted. Alignment notch 24 is sized and shaped to make a slip fit with the protrusion from an ejection port cover detent 103 located on the inside surface of ejection port cover 102. Every AR-style rifle 100 has an ejection port cover detent 103 rigidly attached to the inside surface the ejection port cover 102. Ejection port cover detent 103 functions to lock and hold the ejection port cover 102 closed as stated above. The shape of the protrusion from ejection port cover detent 103 the inside surface the ejection port cover 102 is the same on all AR-style rifles. The shape of the ejection port cover detent 103 on the inside surface the ejection port cover 102 is the same on all AR-style rifles. Alignment notch 24 functions to help guide and locate casing catcher for AR-style rifle 5 properly onto the inside surface of open ejection port cover 102 to allow at least one magnet 22 to reversibly attach or magnetically attach properly to the inside surface of open ejection port cover 102. The operator places the protrusion from ejection port cover detent 103 into the alignment notch 24 as at least one magnet 22 comes into contact with the inside surface of ejection port cover 102 to magnetically attach thereto. This method of alignment and attachment is very effective at properly locating and attaching casing catcher for AR-style rifle 5 to an AR-style rifle 100.

The left edge of magnetic weir plate 20 further comprises an ejection port cover hinge tab 26. Ejection port cover hinge tab 26 is a rigid mass or solid portion of the left edge of magnetic weir plate 20 that contacts the ejection port cover hinge rear protrusion 104. Ejection port cover hinge tab 26 may be of any particular shape. In best mode, ejection port cover hinge tab 26 is a rectangular cuboid as depicted. Every ejection port cover 102 is pivotally attached to the upper receiver by an ejection port cover hinge. The ejection port cover hinge includes two protrusions on the right surface of the upper receiver just beneath the ejection port cover 102. There is a front protrusion and a rear protrusion 104. The ejection port cover hinge tab 26 functions to rest against the rear protrusion 104 of the ejection port cover hinge when the casing catcher for AR-style rifle 5 is properly attached to AR-style rifle 100. The resting of ejection port cover hinge tab 26 against ejection port cover hinge rear protrusion 104 adds stability to the reversible attachment of casing catcher for AR-style rifle 5. The resting of ejection port cover hinge tab 26 against ejection port cover hinge rear protrusion 104 prevents lateral movement or vibrations from left to right as the rifle 100 is firing.

Magnetic weir plate 20 may further comprises an ambidextrous bolt catch clearance notch 28. Ambidextrous bolt catch clearance notch 28 is a void, slot, or cavity located where the rear left corner of magnetic weir plate 20 would be otherwise. Void, slot, or cavity is such that the upper and lower rear left corners of magnetic weir plate 20 are removed and voided as depicted. Thus, the rear left corner of a magnetic weir plate 20 with an ambidextrous bolt catch clearance notch 28 is the rear left corner of ejection port cover hinge tab 26 because of the void to the rear thereof that is the ambidextrous bolt catch clearance notch 28. Ambidextrous bolt catch clearance notch 28 functions to provide clearance space for an ambidextrous bolt catch. A few types AR-style rifles 100 are ambidextrous. An ambidextrous AR-style rifle 100 has features that are operable from both the left side and the right side of the rifle 100. Ambidextrous features have control on both sides. A true ambidextrous AR-style rifle 100 has a bolt catch on the right side as well as a bolt catch at the normal location on the left side of the rifle 100. An ambidextrous bolt catch clearance notch 28 is required for proper attachment and operation of casing catcher for AR-style rifle 5 onto an ambidextrous AR-style rifle 100 with a bolt catch on the right side.

Lock pin receiver 30 is a rigid horizontal support member. Lock pin receiver 30 is made of strong material such as steel, aluminum, hard plastic, composite, carbon fiber, fiberglass, or any other known material with high strength. Lock pin receiver 30 is oblong shaped. Lock pin receiver 30 receiver may have any particular oblong shape such as cylindrical, rectangular cuboid, square cuboid, triangular cuboid, or any other oblong shape. Lock pin receiver 30 has a longitudinal axis, an upper surface, a lower surface, a front end, and a rear end. The longitudinal axis of lock pin receiver 30 is horizontal and parallel with the upper side 12 of cage 10. The longitudinal axis of lock pin receiver 30 is also parallel with the left edge of the upper side 12 of cage 10. Lock pin receiver 30 has a lock pin bore 32 running along its longitudinal axis. Lock pin bore 32 is a cylindrical void or cavity running completely along the longitudinal axis of lock pin receiver 30 from the front end of lock pin receiver 30 to the rear end of lock pin receiver 30. The inner diameter of lock pin bore 32 is sized to make a slip fit with the outer diameter of a lock pin 40. The lower surface of lock pin receiver 30 is rigidly attached to the upper surface of the upper side 12 of cage 10. The upper surface of lock pin receiver 30 has at least one key slot 34. At least one key slot 34 is a slot shaped void with a longitudinal axis that runs perpendicular to the longitudinal axis of lock pin receiver 30. At least one key slot 34 has a width that is sized to make a slip fit with the assembly of first key 50 and second key 60 stacked together. Thus, the width of at least one key slot is the thickness of first key 50 plus the width of second 60 plus the required clearance space for the slip fit. More than one key slot 34 may be used. In best mode, there are three key slots 34 in lock pin receiver 30 as depicted. Lock pin receiver functions to help rigidly attach cage 10 to a lock pin 40.

Lock pin 40 is a rigid horizontal cylindrical member with a longitudinal axis, a first end, and a second end. Lock pin 40 is a lock pin. The second end of lock pin 40 has a lock pin ring attached thereto. Lock pin 40 functions to help rigidly attach first and second keys 50,60 to lock pin 40. Lock pin 40 is reversibly attachable to lock pin receiver 30 by inserting lock pin 40 through lock pin bore 32 and removing lock pin 40 from the lock pin bore 32 by pulling lock pin 40 out of lock pin bore 32 as depicted.

Picatinny rail 105 is a standard feature on an AR-style rifle 100. The shape of picatinny rail 105 is standard and well known in the industry. Picatinny rail 105 is a rigid horizontal oblong rigid member with a longitudinal axis. Picatinny rail 105 has a plurality of ridges 106. Each ridge 106 is specially shaped oblong ridge or protrusion running perpendicular to the longitudinal axis of picatinny rail 105. Each ridge 106 is identical to all other ridges 106. Each ridge 106 has a tapered left side that faces upwards and towards the left. Each ridge 106 has a tapered right side that faces upwards and towards the right. Picatinny rail 105 has a plurality of grooves 107. Each groove 107 is a specially shaped oblong groove, slot, seam, or trough running perpendicular to the longitudinal axis of picatinny rail 105. Each groove 107 is identical to all other grooves 107. Each groove 107 has a tapered left side that faces downwards and to the left. Each groove 107 has a tapered right side that faces downwards and to the right.

First key 50 is a key. First key 50 is an oblong rigid planar member with a left end and a right end. First key 50 has a special shape that is defined by a lock pin hole 52, a key shaft 54, and a right facing foot protuberance 56. Lock pin hole 52 is located on the right end of first key 50. Lock pin hole 52 is a circular shaped void in the rigid planar on the upper side of the right end of oblong rigid planar member as depicted. The inside diameter of lock pin hole 52 is sized to make a slip fit with the outer diameter of a lock pin 40. Right facing foot protuberance 56 is a rigid foot shaped protuberance extending down from the left end of oblong rigid planar member as depicted. The rigid foot shaped protuberance faces towards the right end of the oblong rigid planar member. Right facing foot protuberance 56 functions to make a slip fit with the tapered left side of picatinny rail 105. The shape of the left side of picatinny rail 105 is standard and well known in the industry. Right facing foot protuberance 56 is sized and shaped to be the exact inverse shape of the tapered left side of picatinny rail 105. This inverse shape is a specific shape that looks like the profile of a human foot facing towards the right end of first key 50 as depicted. The foot shape wedges under the tapered left side of picatinny rail 105 to hold first key 50 in place. The top of the foot shape is tapered and shaped like the inverse of the tapered left side of picatinny rail 105. Key shaft 54 is an oblong rigid planar member with lock pin hole 52 at one end and right facing foot protuberance 56 at the other end as depicted. Lock pin 40 is removeably attachable within lock pin hole 52.

Second key 60 is a key. Second key 60 is an oblong rigid planar member with a left end and a right end. Second key 60 has a special shape that is defined by a lock pin hole 62, a key shaft 64, and a left facing foot protuberance 66. Lock pin hole 62 is located on the right end of second key 60. Lock pin hole 62 is a circular shaped void in the rigid planar on the upper side of the right end of oblong rigid planar member as depicted. The inside diameter of lock pin hole 62 is sized to make a slip fit with the outer diameter of a lock pin 40. Left facing foot protuberance 66 is a rigid foot shaped protuberance extending down from the middle of oblong rigid planar member as depicted. The rigid foot shaped protuberance faces towards the left end of the oblong rigid planar member. Left facing foot protuberance 66 functions to make a slip fit with the tapered right side of picatinny rail 105. The shape of the right side of picatinny rail 105 is standard and well known in the industry. Left facing foot protuberance 66 is sized and shaped to be the exact inverse shape of the tapered right side of picatinny rail 105. This inverse shape is a specific shape that looks like the profile of a human foot facing towards the left end of second key 60 as depicted. The foot shape wedges under the tapered right side of picatinny rail 105 to hold second key 60 in place. The top of the foot shape is tapered and shaped like the inverse of the tapered right side of picatinny rail 105. Key shaft 64 is an oblong rigid planar member with lock pin hole 62 at one end and left facing foot protuberance 66 at its mid section as depicted.

Lock pin 40 is removeably attachable within lock pin hole 62. The left end of second key 60 is part of the key shaft 64 as depicted. The key shaft 64 continues further to the left end of second key 60 and beyond left facing foot protuberance 66.

Casing catcher for AR-style rifle 5 is installed onto an AR-style rifle as follows. The ejection port cover 102 must be open. The left edge of magnetic weir plate is positioned adjacent to the inside surface of the open ejection port cover 102. The alignment notch 24 on magnetic weir plate is aligned with or placed concentrically with the protrusion from ejection port cover detent 103 on inside surface of the open ejection port cover 102. Then, at least one magnet 22 on the left edge of magnetic weir plate 20 is pressed against the inside surface of the open ejection port cover 102. With multi magnet 22 modes, all magnets are pressed against the inside surface of the open ejection port cover 102.

Then the operator must find and choose a particular groove 107 out of the plurality of grooves 107 on picatinny rail 105 that is aligned with at least one key slot 34 on lock pin receiver 30, which is designated the alignment groove 107. If using a mode of casing catcher for AR-style rifle 5 with two key slots 34, there would be two aligned grooves 107 to choose from, one groove that aligns with each key slot 34. If using a mode of casing catcher for AR-style rifle 5 with three key slots 34, as depicted, there would be three aligned grooves 107 to choose from, one groove that aligns with each key slot 34. The operator would then chooses one of these aligned grooves 107 in order to continue with the installation. The advantage of having more that one key slot is that this provides alternative alignment grooves 107 for attachment of the casing catcher for AR-style rifle 5 where some alignment grooves 107 on picatinny rail 105 may not be vacant or available because they could already be in use with the attachment of another device to the picatinny rail 105 such as a rifle scope or other device.

After choosing the particular alignment groove 107, the first key 50 is positioned into the alignment groove 107 on picatinny rail 105 by placing first key shaft 54 into the alignment groove 107 with right facing foot protuberance 56 adjacent to and contiguous with the tapered left side of picatinny rail 105 as depicted. The right facing foot protuberance 56 slides under the tapered left side of the alignment groove 107 to wedge or catch itself there, which prevents it from moving upwards. While doing this, the lock pin hole 52 on first key 50 must be positioned concentrically with the lock pin bore 32. Then, second key 60 is positioned into the same alignment groove 107 on picatinny rail 105 by placing second key shaft 64 into the alignment groove 107 with left facing foot protuberance 66 adjacent to and contiguous with the right side of picatinny rail 105 as depicted. The left facing foot protuberance 66 slides under the tapered right side of the alignment groove 107 to wedge or catch itself there, which prevents it from moving upwards. While doing this, the lock pin hole 62 on second key 60 must be positioned concentrically with the lock pin bore 32. First key 50 may be placed into in alignment groove 107 before or after second key 60 is placed into alignment groove 107. First key 50 may be position in front or behind second key 60 when placed into alignment groove 107.

Finally, the first end of lock pin 40 is inserted completely through the lock pin bore 32. The first end of lock pin 40 may be started from the front end of lock pin bore 32 or from the rear end of lock pin bore 32. The placement of lock pin 40 through lock pin bore 32 functions to lock casing catcher for AR-style rifle 5 firmly onto the AR-style rifle 100.

Casing catcher for AR-style rifle 5 must be detached from the rifle 100 in order to empty the accumulated spent casings or cartridges from cage 10. The cage 10 is emptied by turning the casing catcher for AR-style rifle 5 upside down and shaking the accumulated spent casings or cartridges out from the void above the magnetic weir plate 20, through the same void in which the spent casings or cartridges were deposited into the cage 10. In order to remove casing catcher for AR-style rifle 5 from the rifle 100, the above installation procedure should be carried out in reverse order.

What is claimed is:

1. Casing catcher for AR-style rifle comprises: a cage; a magnetic weir plate; a lock pin receiver; a lock pin; a first key; and a second key, wherein, said cage comprises: an upper side, a lower side, a front side, a rear side, a left side, and a right side that are rigidly connected to form an enclosed container or cage with a gap or hole between said left side and said upper side, said magnetic weir plate is a rigid diagonal planar member with an upper surface, a lower surface, a front edge, a right edge, a rear edge, and a left edge, said magnetic weir plate is rigidly attached to said cage and located within said gap or hole between said left side and said upper side of said cage, said left edge of said magnetic weir plate further comprises at least one magnet rigidly attached thereto, said lock pin receiver is a rigid horizontal support member rigidly attached to said upper side of said cage, said lock pin receiver has a longitudinal axis, said lock pin receiver comprises a lock pin bore running parallel to said longitudinal axis of said lock pin receiver, said lock pin is rigid horizontal cylindrical member, said lock pin is removeably attachable within said lock pin bore, said lock pin receiver comprises at least one key slot, at least one key slot is a slot shaped void with a longitudinal axis that runs perpendicular to said longitudinal axis of said lock pin receiver, said first key is an oblong rigid planar member with a right facing foot protuberance and a lock pin hole, said second key is an oblong rigid planar member with a left facing foot protuberance and a lock pin hole, said first and second keys are removeably attachable within said at least one key slot, said lock pin is removeably attachable within said lock pin hole on said first key, and said lock pin is removeably attachable within said lock pin hole on said second key.

* * * * *